US006889891B2

(12) United States Patent
Correll

(10) Patent No.: US 6,889,891 B2
(45) Date of Patent: May 10, 2005

(54) MULTI-FEATURED BOX AND BLANK

(76) Inventor: John D. Correll, 8459 Holly Dr., Canton, MI (US) 48187-4237

( * ) Notice: Subject to any disclaimer, the term of this patent is extended or adjusted under 35 U.S.C. 154(b) by 177 days.

(21) Appl. No.: 10/422,410

(22) Filed: Apr. 23, 2003

(65) Prior Publication Data

US 2004/0211821 A1 Oct. 28, 2004

(51) Int. Cl.[7] ..... B65D 5/28; B65D 5/42

(52) U.S. Cl. ..... 229/112; 229/104; 229/178; 229/904; 229/906

(58) Field of Search ..... 229/104, 112, 229/178, 190, 902, 904, 906; 206/462, 463, 464, 465

(56) References Cited

U.S. PATENT DOCUMENTS

| | | | | | |
|---|---|---|---|---|---|
| 1,751,782 | A | * | 3/1930 | Wells | 229/112 |
| 2,794,585 | A | * | 6/1957 | Wagner | 206/561 |
| 3,013,710 | A | * | 12/1961 | Kronson et al. | 229/117.07 |
| 3,478,950 | A | * | 11/1969 | Stevens | 206/429 |
| 3,904,106 | A | * | 9/1975 | Elder | 229/149 |
| 4,279,374 | A | * | 7/1981 | Webinger | 229/120 |
| 4,763,832 | A | * | 8/1988 | Forbes, Jr. | 229/114 |
| 5,002,221 | A | * | 3/1991 | Ragan | 229/120 |
| 5,211,329 | A | | 5/1993 | Patton | 229/110 |
| 5,494,214 | A | * | 2/1996 | Fleury et al. | 229/149 |
| 5,833,130 | A | | 11/1998 | Correll | 229/108 |
| 5,918,797 | A | | 7/1999 | Correll | 229/108 |
| 5,950,912 | A | * | 9/1999 | Economopoulos | 229/120.32 |
| 5,961,035 | A | * | 10/1999 | Correll | 229/110 |
| 5,971,262 | A | | 10/1999 | Moore et al. | 229/102 |
| 6,179,204 | B1 | * | 1/2001 | Blower et al. | 229/178 |
| 6,290,122 | B1 | * | 9/2001 | Correll | 229/104 |

FOREIGN PATENT DOCUMENTS

| | | |
|---|---|---|
| GB | 1163521 | 9/1969 |

OTHER PUBLICATIONS

Papa John's Pizza Box—Photo taken by John Correll—Apr. 16, 2003.

* cited by examiner

*Primary Examiner*—Gary E. Elkins

(57) ABSTRACT

A box and/or blank comprising one or more of the following features: (1) a unique configuration of wall panels comprising a first wall panel, second and third wall panels disposed adjacent the first wall panel, and a fourth wall panel disposed at an acute angle to one of the second and third wall panels and at an obtuse angle to the other of the second and third wall panels; (2) a wall panel having a unique end-edge structure comprising a fold line portion and a free-edge portion, the fold line portion being a fold line attaching a corner flap panel to the end of the wall panel and the free-edge portion extending from a bottom point of the fold line to an edge of the bottom panel of the box or blank; (3) a unique tab engagement structure comprising first and second slits in a first panel that's joined at a fold line to a second panel, the first slit being disposed approximately parallel to the fold line and the second slit intersecting the first slit and extending toward and at least part way to the fold line; (4) a cup-holder wall structure engaged with a double-panel wall structure; and (5) a covered cup-holder strap opening wherein at least of a portion of a cover flap covers at least a portion of the cup-holder strap opening.

21 Claims, 3 Drawing Sheets

MULTI-FEATURED BOX AND BLANK

FIELD OF THE INVENTION

This invention relates to packaging in general and in particular to cartons for food products such as pizza, breadsticks, chicken wings, and the like.

BACKGROUND OF THE INVENTION

In the pizza industry, millions of pizzas are sold each year for delivery and carry-out. Most of these pizzas are packed in the same types of cartons. Nearly all of these cartons are square-shaped pizza boxes. Most of these square-shaped pizza boxes have a double-panel front wall structure comprising parallel inner and outer panels. A front corner flap panel appending from a front end of each of the side walls is enclosed between these inner and outer panels, thereby creating connected front corners on the box. Further, the inner panel of the double-panel front wall structure is held in place by having a tab at the bottom edge of the panel which fits within a slot in the bottom of the box. This slot is a relatively large opening that occasionally allows "pizza juices" collecting in the bottom of the box to drip from the box. In addition, this slot is typically created by a flip-tab structure located at the bottom edge of the outer panel. When the blank is erected into a box, this flip-tab structure opens up, thereby creating the slot. However, it also produces a tab projecting downward from the bottom edge of the outer panel. As a result, when multiple units of this box are stacked, as most pizzerias do, the outcome can be a tippy, crooked, non-level stack of boxes.

Also, many of these boxes have a cup-holder strap located within a rear corner of the box. This is created by having a strap-creating corner flap panel that appends to a rear end of one of the side walls. A result of this structure is a large, gaping opening in the side wall of the box.

Finally, the side walls of most of these boxes have a particular end-edge structure in which the fold line that connects the rear corner flap panel to a side wall is disposed vertically and also flush to a rear wall of the box, thereby requiring the use of a vertical rear wall (and preventing the use of a material-saving inward-sloping rear wall).

It would be desirable to have a pizza box that comprises a structure that affords a number of functionality-enhancing opportunities, specifically:

1) The opportunity to have a box shape other than that of the boxes of the prior art and, particularly, other than that of a square shape, while still employing only four wall panels and also having the opposing side wall panels parallel to one another;

2) The opportunity to have a cup-holder strap disposed in a front corner of the box rather than the rear corner, thereby freeing up the rear end-edge of the side walls for alternate structural configurations, if so desired;

3) The opportunity to cover up, or cover over, the opening in a wall panel created by a deployed cup-holder strap, thereby reducing heat-loss from the box;

4) The opportunity to keep the inner panel of a double-panel wall structure securely in place without having to have a large open slot in the bottom of the box or use a flip-tab structure to create the slot; and 5) The opportunity to have an inward-sloping rear wall.

My invention affords attainment of all of these opportunities.

Prior art related to my invention includes the following patents: Patton U.S. Pat. No. 5,211,329 granted May 18, 1993; Correll U.S. Pat. No. 5,833,130 granted Nov. 10, 1998; Correll U.S. Pat. No. 5,918,797 granted Jul. 6, 1999; Moore et al. U.S. Pat. No. 5,971,262 granted Oct. 26, 1999; and Earl Great Britain patent 1,163,521 granted Sep. 10, 1969.

Patton, Correll '130, and various other prior art pizza boxes disclose a non-square pizza box. However, most of these boxes employ more than four wall panels for achieving the non-square shape. This can sometimes result in a floppy feel, a non-rigid structure, or a "weakened" box. Accordingly, it would be desirable to achieve a unique non-square shape by employing four walls only.

Correll '797 discloses boxes having four walls only and a non-square shape but the side walls are disposed non-parallel to one another. This can result in material waste in manufacture of the box blank. Accordingly, it would be desirable to have a box of non-square shape that has four walls only and has parallel side walls.

Patton also discloses a particular type of tab engagement structure for a double-panel wall structure comprising parallel inner and outer panels. This tab engagement structure consists of a slit in the bottom panel of the box, the slit being disposed parallel to the fold line connecting the outer panel of the double-panel wall structure to the bottom panel of the box. This particular tab engagement structure eliminates having a slot in the bottom of the box. However, it fails to provide a secure engagement for the inner panel of the double-panel wall, thereby increasing the chance of the inner panel slipping out of position.

Moore et al. and Earl each disclose a box having a side wall having a flap panel attached to the end of the side wall at a fold line with the fold line being non-flush with an adjacent end wall. However, the end-edge structure of the side wall is such that it would allow fluid (e.g., "pizza juices") within the box cavity to flow out of the corner of the box.

A national pizza chain by name of Papa John's International, Inc. has a pizza box with a cup-holder strap disposed in a corner flap panel of the box. However, this cup-holder strap is disposed in a rear corner flap panel, thereby restricting the type of end-edge structure that can be used at the rear end of the side walls. Further, the opening created in the side wall by the deployed cover panel is not covered in any way, thereby resulting in the potential for substantial loss of heat from the box.

So, there has remained a number of problems associated with prior art pizza boxes. My invention solves these problems. By doing such, the invention provides a pizza box of improved functionality and marketing potential.

SUMMARY OF THE INVENTION

My invention is a box and corresponding blank involving one or more of the following structural features:

1. A box having a unique configuration of wall panels comprising a first wall panel, second and third wall panels disposed adjacent the first wall panel, and a fourth wall panel disposed at an acute angle to one of the second and third wall panels and at an obtuse angle to the other of the second and third wall panels;

2. A blank having a unique bottom panel structure comprising a first edge, second and third edges disposed perpendicular to the first edge, and a fourth edge disposed at an acute angle to one of the second and third edges and at an obtuse angle to the other of the second and third edges;

3. A blank having a wall panel having a unique end-edge structure comprising a fold line portion and a free-edge portion, the fold line portion being a fold line attaching a corner flap panel to the end of the wall panel and the free-edge portion extending from a bottom point of the fold line to an edge of the bottom panel of the blank;

4. A blank having a unique tab engagement structure comprising first and second slits in a first panel that's joined at a fold line to a second panel, the first slit being disposed approximately parallel to the fold line and the second slit intersecting the first slit and extending toward and at least part way to the fold line;

5. A box having a cup-holder wall structure engaged with a double-panel wall structure, wherein (a) the cup-holder wall structure comprises a wall panel, a strap-creating corner flap panel attached to the end of the wall panel, and a deployed cup-holder strap extending from the wall panel to the corner flap panel, (b) the double-panel wall structure comprises parallel inner and outer panels, and (c) at least a portion of the strap-creating corner flap panel is disposed between the inner and outer panels of the double-panel wall structure; and 6. A box having a covered cup-holder strap opening wherein at least a portion of a cover flap covers at least a portion of the cup-holder strap opening.

My invention typically would be used for packaging relatively flat food products such as pizza; however, it could take other forms for other purposes, as well.

A complete understanding of the invention can be obtained from the detailed description that follows.

OBJECT AND ADVANTAGES

The main object of my invention is a blank and box that provides improved packaging for food products such as pizza.

The main advantages of my invention are (a) enhanced marketing opportunities through employment of a unique box shape, (b) cost savings through employment of a unique end-edge structure that allows an inward-sloping end wall, (c) improved double-panel wall engagement structure resulting in a slot-free and tab-free tab engagement structure, (d) expanded box utility through combining a cup-holder wall structure with a double-panel wall structure, thereby enabling removal of the cup-holder strap from the rear corner flap panel of a side wall, and (e) hotter delivered pizza through covering the opening created by a deployed cup-holder strap with a cover flap.

Further objects and advantages of the invention will become apparent from consideration of the following detailed description, related drawings, and appended claims.

LIST OF REFERENCE NUMERALS

Figure 1:
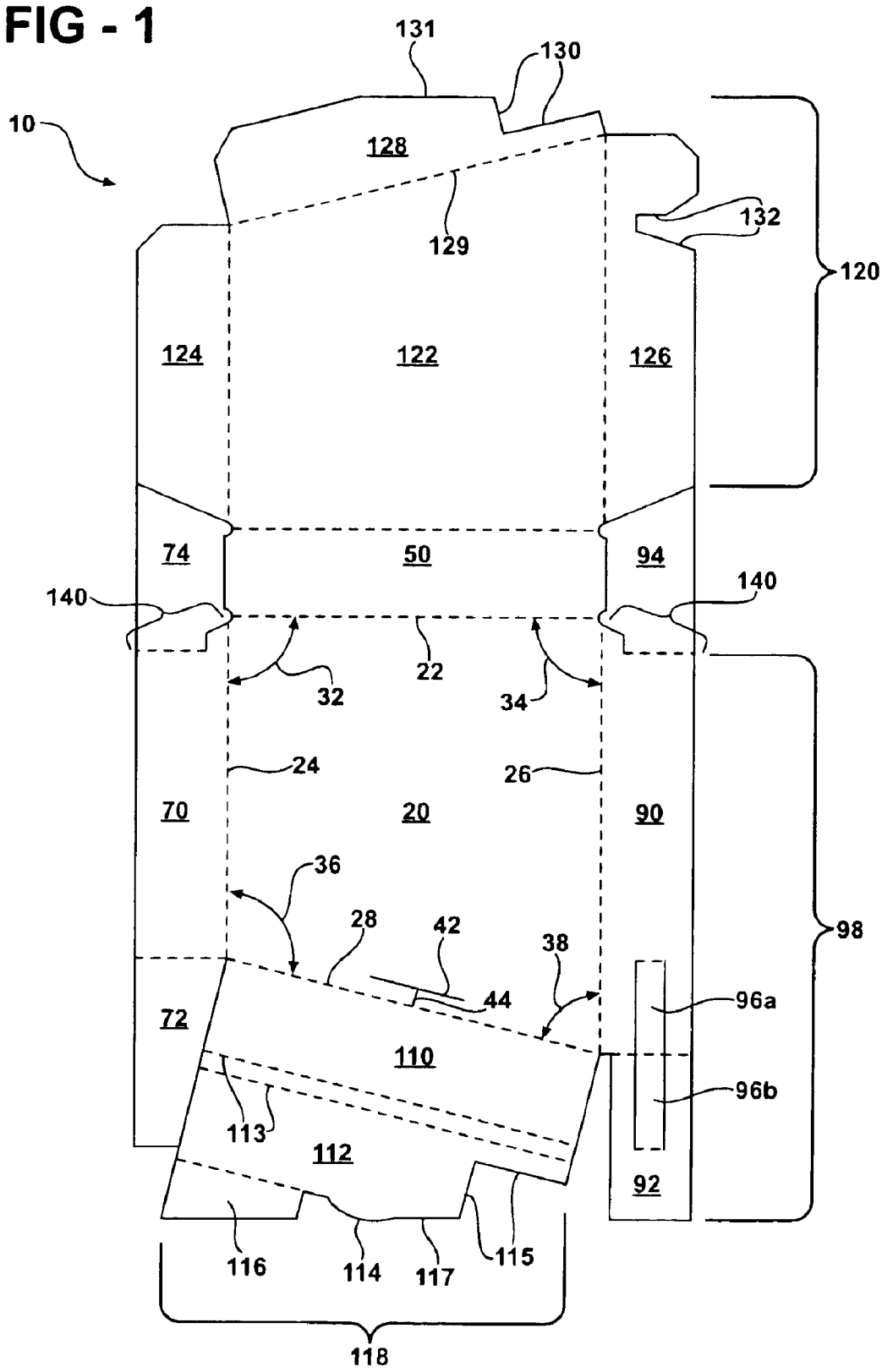
FIG. 1 is a plan view of the blank of the preferred embodiment.

Within a drawing, closely related components have the same number but different alphabetic suffixes. Between drawings, like reference numerals designate corresponding parts.

| | |
|---|---|
| 10 | blank of the preferred embodiment |
| 12 | box of the preferred embodiment |
| 20 | bottom panel |
| 22 | first edge (rear edge/fold line) |
| 24 | second edge (left side edge/fold line) |
| 26 | third edge (right side edge/fold line) |
| 28 | fourth edge (front edge/fold line) |
| 32/32a | first angle |
| 34/34a | second angle |
| 36/36a | third angle |
| 38/38a | fourth angle |
| 42 | first slit of tab engagement structure |
| 44 | second slit of tab engagement structure |
| 46 | crushed area |
| 50 | first wall panel (rear wall) |
| 70 | second wall panel (left side wall) |
| 72 | front corner flap panel |
| 74 | rear corner flap panel |
| 90 | third wall panel (right side wall) |
| 92 | front corner flap panel (strap-creating corner flap panel) |
| 94 | rear corner flap panel |
| 96a | component of cup-holder strap |
| 96b | component of cup-holder strap |
| 98 | cup-holder wall structure |
| 110 | fourth wall panel (front wall/outer panel of double-panel wall structure) |
| 112 | ancillary panel (inner panel of double-panel front wall structure) |
| 113 | pair of parallel fold lines |
| 114 | engagement tab |
| 115 | notch |
| 116 | squaring-off flap |
| 117 | bottom edge of ancillary panel |
| 118 | double-panel front wall structure |
| 120 | cover |
| 122 | cover panel |
| 124 | left cover side flap |
| 126 | right cover side flap |
| 128 | cover front flap |
| 129 | top edge of cover front flap |
| 130 | notch |
| 131 | bottom edge of cover front flap |
| 132 | notch |
| 134 | cup-holder strap opening (in side wall) |
| 140 | end-edge structure |
| 142 | fold line |
| 144 | first free edge |
| 146 | second free edge |
| 150 | bottom end point of fold line |
| 152 | intersection point of edges |
| 154 | acute angle |
| 156 | oblique angle |
| 160 | opening |
| 162 | first thermal-leg |
| 164 | second thermal-leg |
| 166 | height of thermal-leg |
| 168 | height of thermal-leg |

DESCRIPTION OF THE PREFERRED EMBODIMENT

Referring now to the drawings, there is illustrated a preferred embodiment of the invention in the format of a one-piece blank made of corrugated paperboard and, correspondingly, in the format of a box created from the blank. The intended use for the embodiment is as a food carton or, specifically, a pizza box. However, it will be appreciated, as the description proceeds, that my invention may be realized in different embodiments and may be used in other applications.

Figure 2:
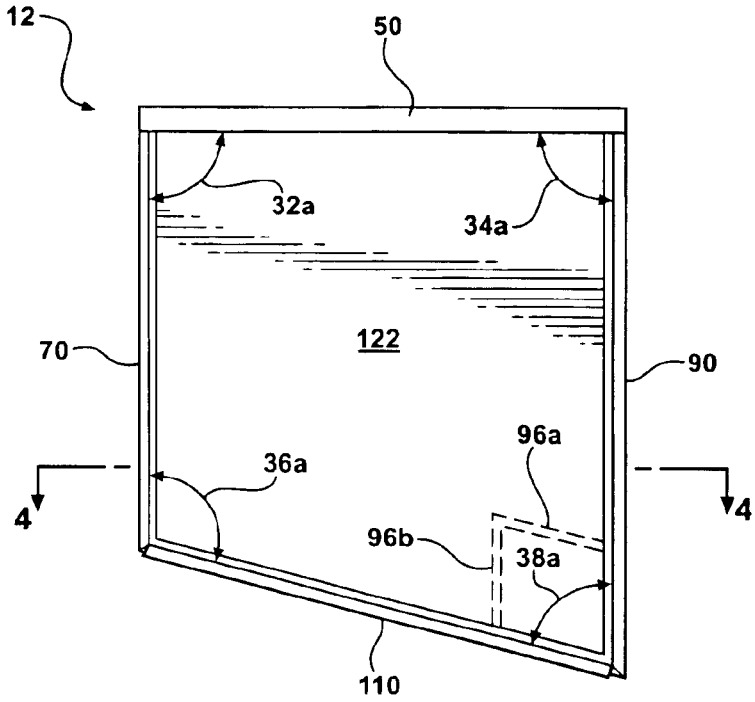
FIG. 2 is a top view of the box made from the blank of FIG. 1.
Figure 3:
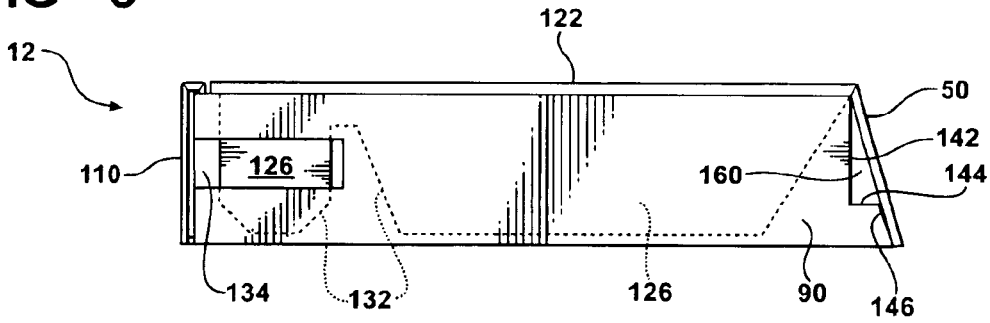
FIG. 3 is a right side elevation view of the box.
Figure 4:
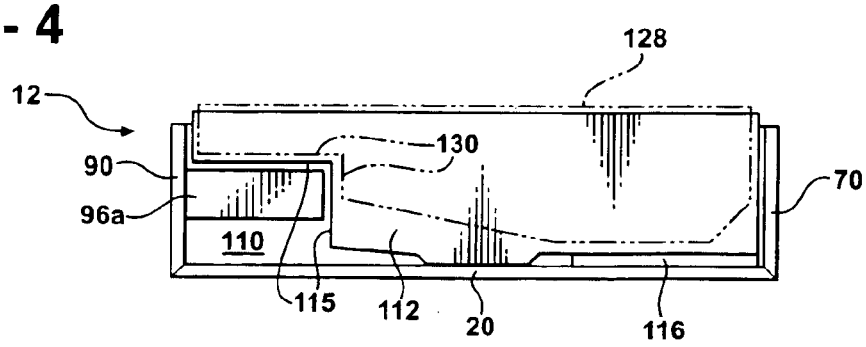
FIG. 4 is a sectional view of the box taken through line 4—4 (shown in FIG. 2).

FIG. 1 shows a blank 10 and FIGS. 2, 3, and 4 show a box 12 created from blank 10. Referenced components are labeled in FIG. 1; selected components are labeled in other Figures. Corresponding parts between drawings share a same reference numeral.

Structure of the Preferred Embodiment

Referring in particular to FIG. 1 which shows blank 10, the preferred embodiment of the invention comprises a plurality of components including a bottom panel 20 and a first wall panel 50, a second wall panel 70, a third-wall panel 90, and a fourth wall panel 110 each hingedly attached to bottom panel 20 at respective fold lines (indicated by dashed lines in the drawing). These wall panels 50, 70, 90, and 110 happen to be the rear, left side, right side, and front wall panels, respectively, of the preferred embodiment.

Bottom panel 20 has a first edge 22, a second edge 24, a third edge 26, and a fourth edge 28. These edges 22, 24, 26, and 28 happen to be the rear, left side, right wide, and front edges, respectively, of the bottom panel of the preferred embodiment. The numerals 22, 24, 26, and 28 also represent corresponding respective fold lines connecting wall panels 50, 70, 90, and 110 to bottom panel 20 and, further, represent the respective bottom edges of these wall panels.

Angles exist between adjacent edges of the bottom panel. There is a perpendicular angle 32 between first edge 22 and second edge 24, a perpendicular angle 34 between first edge 22 and third edge 26, an obtuse angle 36 between second edge 24 and fourth edge 28, and an acute angle 38 between third edge 26 and fourth edge 28. This results in second and third edges 24, 26 being parallel and first and fourth edges 22, 28 being non-parallel.

Figure 5:
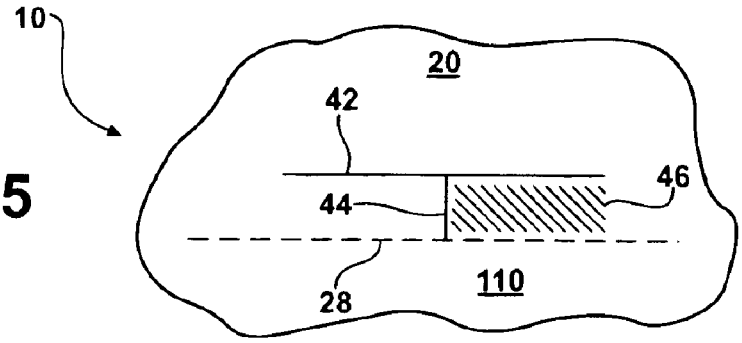
FIG. 5 is a plan view of a section of the blank.

Disposed within bottom panel 20 is a tab engagement structure comprised of a first slit 42 and a second slit 44. First slit 42 is approximately parallel to fourth edge (fold line) 28 and second slit 44 intersects slit 42 and extends toward and at least part way to edge (fold line) 28. (In the preferred embodiment, slit 44 extends all the way to edge 28.) Referring to FIG. 5 which shows an enlargement of this tab engagement structure, there is an area of crushed material 46, indicated by hatching in the drawing, which is located adjacent slits 42/44. This area is crushed during manufacture of the blank to cause the fluted (inner) layer of the corrugated board to be flattened, thereby reducing the rigidity of that area of the board. For clarity of illustration, FIG. 5 shows only one crushed area 46. However, in the actual blank of the preferred embodiment there also would be another crushed area disposed on the other side of slit 44, opposing area 46 shown in the drawing.

Hingedly attached to front and rear ends of second wall panel 70 are front and rear corner flap panels 72, 74, respectively.

Hingedly attached to front and rear ends of third wall panel 90 are front and rear corner flap panels 92, 94, respectively. Disposed within third wall panel 90 and front corner flap panel 92 is a cup-holder strap comprised of first and second portions 96*a*, 96*b*. A corner flap panel that happens to contain a cup-holder strap is referred to herein as a "strap-creating corner flap panel." In addition, the combination of a wall panel (e.g., 90), a corner flap panel (e.g., 92), and a cup-holder strap (e.g., 96*a*/*b*) constitute a structure referred to herein as a "cup-holder wall structure," indicated by numeral 98 in the drawing.

Figure 6:
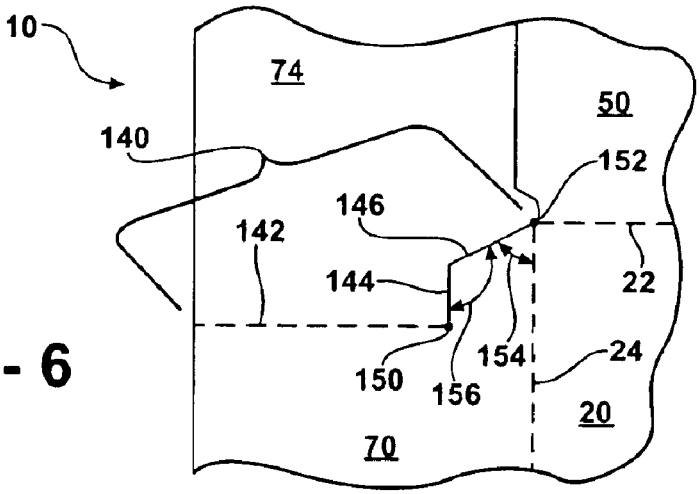
FIG. 6 is a plan view of a section of the blank.

The rear end of each of second and third wall panels 70, 90 has a unique end-edge structure 140. Referring to FIG. 6 which shows an enlargement of the end-edge of wall panel 70, it can be seen that end-edge structure 140 comprises a fold line portion and a free-edge portion. The fold line portion is constituted by a fold line 142 that extends from the top edge of wall panel 70 to a bottom end point 150, whereby fold line 142 stops short of reaching edge 24. The free-edge portion is constituted by contiguous first and second free edges, or slits, 144 and 146, respectively. Free-edge portion (144/146) extends from bottom end point 150 to edge 24. It is further noted that edge 24 is intersected by edge 22 at intersection point 152. Free-edge portion 144/146 intersects intersection point 152. It is further noted that free edge 146 is disposed at an acute angle 154 to edge 24 and that free edges 144 and 146 are disposed to one another at an oblique angle 156.

Hingedly linked to a top edge of fourth wall panel 110 is an ancillary panel 112. Ancillary panel 112 is linked at its top edge to fourth wall panel 110 by a pair of narrowly-spaced parallel fold lines 113. Lines 113 indicate the top edge of ancillary panel 112. In addition, ancillary panel 112 has a bottom edge 117, a portion of which is disposed non-parallel to the top edge. The panels 110 and 112 happen to be the outer and inner panels, respectively, of a double-panel wall structure in the preferred embodiment, this structure being indicated by numeral 118 in the drawing.

Projecting from a bottom edge of ancillary panel (inner panel) 112 is an inner panel engagement tab 114. After blank 10 has been erected into box 12, engagement tab 114 engages within the tab engagement structure (i.e., slits 42, 44) in bottom panel 20. Specifically, in the box format engagement tab 114 is disposed between slit 42 and edge 28. Ancillary panel 112 is dimensioned such that the bottom edge of engagement tab 114 is disposed slightly below the top surface of bottom panel 20. Slit 44 in combination with crushed area(s) 46 enable this to happen. The exact dimensions of ancillary panel 112 vary depending on the thickness (or flute) of the corrugated board and, therefore, must be derived from testing, a process that is easily managed by any person or box designer skilled in the art.

Ancillary panel 112 also has a notch 115 disposed therein. After the blank has been erected into a box, notch 115 allows cup-holder strap 96*a*/*b* to be deployed, or put into the position shown in FIGS. 2 and 4. In this position, strap component 96*a* is disposed at an angle to third wall panel 90 and strap component 96*b* is disposed at an angle to fourth wall panel 110 and ancillary panel 112.

As illustrated in FIG. 4 which shows a rear sectional view of box 12 (taken along line 4—4 of FIG. 2), it can be seen how notch 115 enables cup-holder strap 96*a*/*b* to extend into the cavity of the box. For purposes of clarity, this drawing does not depict the cover panel, so it would be a view taken with the cover panel in opened disposition.

Hingedly attached to a bottom edge of ancillary panel 112 is a squaring-off flap 116. Squaring-off flap 116 serves the purpose of creating a straight edge across the end of blank 10 for facilitating high-speed production and stacking of multiple blanks. As such, it is optional. After the blank has been erected into a box, flap 116 overlies bottom panel 20.

The blank and box further include a cover 120 which comprises a cover panel 122 hingedly attached to a top edge of first wall panel 50, opposing left and right cover side flaps 124 and 128, respectively, hingedly attached to left and right sides of cover panel 122, and a cover front flap 128 hingedly attached at fold line 129 to a front edge of cover panel 122. Fold line 129 also represents the top edge of cover front flap 128. Cover front flap 128 has a bottom edge 131, a portion of which is disposed non-parallel to top edge 129. Cover front flap 128 also has a notch 130 disposed therein. After the blank has been erected into a box, notch 130 allows cup-holder strap 96*a/b* to be deployed, or put into the position shown in FIGS. 2 and 4. So, as can be seen, cover front flap 128 has an edge disposed adjacent deployed cup-holder strap 96*a/b*. Referring specifically to FIG. 4, the position of cover front flap 128 is depicted by phantom lines (alternating dashes and double dots) to indicate the relationship of cup-holder strap 96*a/b* and notch 130. A cover front flap that is configured to clear a deployed cup-holder strap is referred to herein as a "cup-holder-strap-clearing front flap."

When cup-holder-strap 96*a/b* is deployed it results in a cup-holder strap opening 134 that is disposed within fourth wall panel 90 (see FIG. 3). Cover side flap 126 includes a notch 132 therein (FIGS. 1 and 3). When cover 120 is in closed disposition, a portion of cover side flap 126 covers a portion of cup-holder strap opening 134, thereby reducing air flow and heat loss from the box. Notch 132 enables flap 126 to clear deployed cup-holder strap component 96*a* and, thereby, cover a portion of cup-holder strap opening 134. In so doing, cup-holder strap 96*a/b* is disposed within notch 132.

It is fairly self-evident from the structure of the blank what the structure of the box will be. However, to insure clarity, the salient features of box 12 will now be described. Referring to FIG. 2 which shows a top view of the box, there is a perpendicular angle 32*a* between first wall panel 50 and second wall panel 70, a perpendicular angle 34*a* between first wall panel 50 and third wall panel 90, an obtuse angle 36*a* between second wall panel 70 and fourth wall panel 110, and an acute angle 38*a* between third wall panel 90 and fourth wall panel 110. This results in second and third wall panels 70, 90 being parallel and first and fourth wall panels 50, 110 being non-parallel. In addition, it can be seen how deployed cup-holder strap 96*a/b* extends into the box cavity (i.e., cavity portion of the box) with the components of the strap being disposed at an angle to adjacent wall panels.

Referring to FIG. 3 which shows a right side elevation view, it can be seen that the deployed cup-holder strap 96*a/b* produces a cup-holder strap opening 134 within wall panel 90. However, a portion of this opening is closed, or covered over, by a portion of cover side flap 126. This function is enabled by notch 132 in the cover side flap. Further, it can be seen that, due to the configuration of end-edge structure 140 of wall panel 90, there is an opening 160 between fold line 142 and first wall panel (rear wall) 50. This opening facilitates uniform air flow at the rear of the box cavity. Further, it is noted that first wall panel 50 slants inward, or is disposed at an acute angle to the bottom panel of the box. This serves to conserve material.

Referring to FIG. 4 which shows a sectional view of box 12 (taken along line 4—4 of FIG. 2), it can be seen how notch 115 in ancillary panel 112 enables the ancillary panel to clear deployed cup-holder strap 96*a/b*. It can further be seen how notch 130 in cover front flap 128 enables the cover front flap to also clear the cup-holder strap. With ancillary panel 112 in erected position, squaring-off flap 116 is automatically disposed in a position overlying bottom panel 20, which in effect puts flap 116 "out of the way" of any pizza contained in the box.

Figure 7:
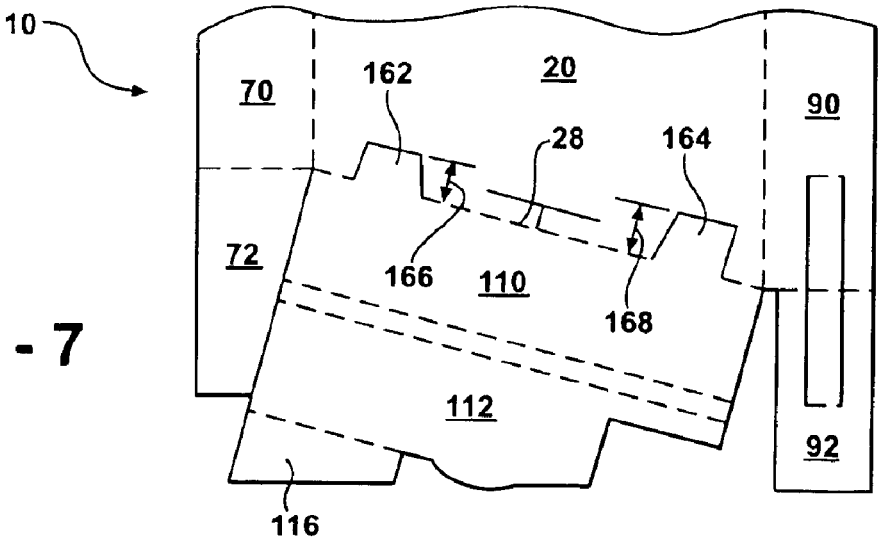
FIG. 7 is a plan view of a section of the blank with optional thermal-legs.

An optional version of the preferred embodiment would involve the inclusion of thermal-legs, or downward projections from the bottom edge of fourth wall panel 110. The structure and function of thermal-legs are described in my U.S. Pat. Nos. 5,833,130; 5,961,035; and 6,206,277, and is included herein by reference thereto. Referring to FIG. 7 which shows a partial section of blank 10, a pair of thermal-legs 162 and 164 project from a bottom edge of front wall 110. Thermal-legs 162, 164 have heights 166, 168, respectively, which extend from edge 28 to the bottom edge of each thermal-leg. It is noted that heights 166, 168 are unequal; specifically, height 166 being less than height 168.

Method for Erecting the Blank into the Box

Blank 10 can be erected into box 12 by the same method as used for erecting a standard square pizza box with a double-panel front wall structure. That method is, essentially, as follows.

First, simultaneously fold side wall panels 70, 90 to an upright position and fold front corner flap panels 72, 92 inward.

Second, while holding side wall panels 70, 90 in upright position, fold front wall panel 110 to an upright position and then fold ancillary panel 112 downward until tab 114 engages behind slit 42.

Third, fold rear corner flap panels 74, 94 inward.

Fourth, fold cover 120 upright and fold cover flaps 124, 126, and 128 inward, and then close the cover on the box.

To deploy the cup-holder strap, with the cover open, push strap component 96*a* inward to make it partially project into the box cavity. Then from inside the box cavity, pull the cup-holder strap all the way out.

Within the drawing of the blank, a fold line between component parts of the invention is depicted with a dashed line. Within the context of this invention, a fold line can be created by a number of means such as, for example, by a crease or score in the board, by a series of aligned spaced short slits in the board, and by a combination of aligned spaced short and long slits. In conclusion, as referred to herein, a fold line is any line between two points on the blank or box along which the board is intended to be folded when the blank is being erected into a box or when the box is being manipulated as described herein. The type of fold lines shown in the drawings are presently preferred but it will be appreciated that other methods known to those skilled in the art may be used.

CONCLUSION, RAMIFICATIONS, AND SCOPE

I have disclosed a blank and corresponding box involving one or more of the following structural features: (1) a unique configuration of wall panels comprising a first wall panel, second and third wall panels disposed adjacent the first wall panel, and a fourth wall panel disposed at an acute angle to one of the second and third wall panels and at an obtuse angle to the other of the second and third wall panels; (2) a wall panel having a unique end-edge structure comprising a fold line portion and a free-edge portion, the fold line portion being a fold line attaching a corner flap panel to the end of the wall panel and the free-edge portion extending from a bottom point of the fold line to an edge of the bottom panel of the box or blank; (3) a unique tab engagement structure comprising first and second slits in a first panel that's joined at a fold line to a second panel, the first slit being disposed approximately parallel to the fold line and the second slit intersecting the first slit and extending toward and at least part way to the fold line; (4) a cup-holder wall structure engaged with a double-panel wall structure; and (5) a covered cup-holder strap opening wherein at least of a portion of a cover flap covers at least a portion of the cup-holder strap opening.

Within the foregoing discussion of the invention, the labeling of any components by a numerical adjective (i.e., "first," "second," etc.) is for reference purposes only and does not denote any particular location of the components within the blank or carton. Further, the term "hingedly attached" refers to two panels (or a panel and a flap) joined together at a fold line, and does not imply any degree of movability of the panels in the erected box format.

The illustrated number, size, shape, type, and placement of components represent the preferred embodiment; however, many other combinations and configurations are possible within the scope of the invention. For example, an alternate configuration would be to have a slot in the top edge of front wall structure 118, or between fold lines 113, and have a narrow cover front flap 128 configured to fit within the slot. If this were done, this narrower flap 128 would still be considered to be a cup-holder-strap-clearing front flap and within the scope of the invention.

The foregoing discussion has pertained mainly to packaging relatively flat food products such as pizza. However, it should be realized that my invention could be used for other purposes, as well. In conclusion, it is understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

I claim:

1. A one-piece box having a unique configuration of wall panels, said box being of foldable material and comprising;

a bottom panel, a plurality of wall panels including first, second, third, and fourth wall panels, and a cover hingedly attached to said first wall panel;

wherein said second and third wall panels are disposed perpendicular to said first wall panel and said fourth wall panel is disposed at an acute angle to one of said second and third wall panels and at an obtuse angle to the other of said second and third wall panels.

2. The box of claim 1 wherein:

said fourth wall panel is a part of a double-panel wall structure comprising an outer panel and an inner panel hingedly linked to said outer panel at a top edge, said inner panel having a bottom edge, at least a portion of said bottom edge being disposed non-parallel to said top edge.

3. The box of claim 1 wherein:

said cover comprises a cover panel and a cover front flap hingedly attached to said cover panel and having top and bottom edges, at least a portion of said bottom edge being disposed non-parallel to said top edge.

4. A blank for a box having a unique bottom panel structure, said blank being of foldable material cut and scored to define:

a bottom panel having a plurality of edges including first, second, third, and fourth edges, and a plurality of wall panels including respective first, second, third, and fourth wall panels hingedly attached to said first, second, third, and fourth edges;

wherein said second and third edges are disposed perpendicular to said first edge and said fourth edge is disposed at an acute angle to one of said second and third edges and at an obtuse angle to the other of said second and third edges.

5. The blank of claim 4 wherein:

said fourth wall panel is a part of a double-panel wall structure comprising an outer panel and an inner panel hingedly linked to said outer panel at a top edge, said inner panel having a bottom edge, at least a portion of said bottom edge being disposed non-parallel to said top edge.

6. The blank of claim 4 wherein:

said fourth wall panel is a part of a double-panel wall structure comprising an outer panel and an inner panel hingedly linked to said outer panel at a top edge, said double-panel wall structure having a squaring-off flap hingedly attached to said inner panel.

7. The blank of claim 4 wherein:

said fourth wall panel has a thermal-leg projecting downward from a bottom edge.

8. The blank of claim 4 wherein:

said fourth wall panel has first and second thermal-legs projecting downward from a bottom edge by respective predetermined first and second distances, wherein the first predetermined distance is less than the second predetermined distance.

9. The blank of claim 4 further comprising:

a cover comprising a cover panel hingedly attached to said first wall panel and a cover front flap hingedly attached to said cover panel and having top and bottom edges, at least a portion of said bottom edge being disposed non-parallel to said top edge.

10. The blank of claim 4 further comprising:

a cover comprising a cover panel hingedly attached to said first wall panel and a cover front flap hingedly attached to said cover panel and having a notch disposed therein.

11. A blank for a box having a wall panel having a unique end-edge structure, said blank being of foldable material cut and scored to define:

a bottom panel having an edge, a wall panel hingedly attached to said edge, and a corner flap panel hingedly attached to an end of said wall panel;

wherein said wall panel has a predetermined end-edge structure comprising a fold line portion and a tree-edge portion, said fold line portion being a fold line attaching said corner flap panel to said wall panel and having a bottom end point disposed free of intersection with the edge of said bottom panel and said free-edge portion extending from said bottom end point to said edge.

12. The blank of claim 11 wherein:

at least a portion of said free-edge portion is disposed at an acute angle to the edge of said bottom panel.

13. The blank of claim 11 wherein:

said bottom panel further has another edge intersecting said edge at an intersection point and said free-edge portion extends to said intersection point.

14. The blank of claim 11 wherein:

said free-edge portion comprises first and second portions disposed at an oblique angle to one another.

15. A box having a covered cup-holder strap opening in a wall panel, said box being of foldable material and comprising:

a bottom panel, a cup-holder wall structure comprising a wall panel, a strap-creating corner flap panel hingedly attached to an end of said wall panel, and a deployed cup-holder strap extending from said wall panel to said corner flap panel, whereby a cup-holder strap opening exists in said wall panel, and a cover comprising a cover panel and a cover flap hingedly attached to said cover panel;

wherein at least a portion of said cover flap covers at least a portion of said cup-holder strap opening.

16. The box of claim 15 wherein:

said cover flap has a notch and said deployed cup-holder strap is disposed within said notch.

17. A one-piece box having a unique configuration of wall panels, said box being of foldable material and comprising:

a bottom panel, a plurality of wall panels including first, second, third, and fourth wall panels, and a cover hingedly attached to said first wall panel;

wherein said second and third wall panels are disposed adjacent said first wall panel and said fourth wall panel is disposed at an acute angle to one of said second and third wall panels and at an obtuse angle to the other of said second and third wall panels and said fourth wall panel is a part of a double-panel wall structure comprising an outer panel and an inner panel hingedly linked to said outer panel at a top edge, said inner panel having a bottom edge, at least a portion of said bottom edge being disposed non-parallel to said top edge.

18. A one-piece box having a unique configuration of wall panels, said box being of foldable material and comprising:

a bottom panel, a plurality of wall panels including first, second, third, and fourth wall panels, and a cover hingedly attached to said first wall panel;

wherein said second and third wall panels are disposed adjacent said first wall panel and said fourth wall panel is disposed at an acute angle to one of said second and third wall panels and at an obtuse angle to the other of said second and third wall panels and said cover comprises a cover panel and a cover front flap hingedly attached to said cover panel and having top and bottom edges, at least a portion of said bottom edge being disposed non-parallel to said top edge.

19. An improved tab engagement structure on a box blank, said blank being of foldable material cut and scored to define first and second panels hingedly attached at a fold line, the tab engagement structure being disposed in said first panel;

wherein the improvement comprises first and second slits in said first panel, said slits extending all the way through said foldable material, the first slit being disposed substantially parallel to said fold line and the second slit medially intersecting said first slit and extending toward and at least part way to said fold line.

20. The blank of claim 19 wherein:

said foldable material is corrugated board;

said improvement further comprises at least one crushed area on said first panel, said at least one crushed area being adjacent the medial intersection of said second slit with said first slit.

21. The blank of claim 20 wherein:

said tab engagement structure essentially consists of said first and second slits.

* * * * *